US007182429B2

(12) United States Patent
Iwata

(10) Patent No.: US 7,182,429 B2
(45) Date of Patent: Feb. 27, 2007

(54) LIQUID DISCHARGER AND METHOD FOR DISCHARGING LIQUID DROPLETS

(75) Inventor: Yuji Iwata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 346 days.

(21) Appl. No.: 10/827,427

(22) Filed: Apr. 20, 2004

(65) Prior Publication Data

US 2004/0257399 A1 Dec. 23, 2004

(30) Foreign Application Priority Data

Apr. 25, 2003 (JP) ..... 2003-121677

(51) Int. Cl.
*B41J 2/145* (2006.01)
*B41J 2/15* (2006.01)

(52) U.S. Cl. ..... 347/40; 347/17; 347/56; 347/60

(58) Field of Classification Search ..... 347/40
See application file for complete search history.

(56) References Cited

U.S. PATENT DOCUMENTS 6,336,715 B1 * 1/2002 Hotomi et al. ..... 347/68
6,371,598 B1 * 4/2002 Fujii et al. ..... 347/54

FOREIGN PATENT DOCUMENTS

JP A-02-277641 11/1990
JP A-09-141848 6/1997
JP A-09-141868 6/1997
JP A-11-207533 8/1999
JP A-11-254701 9/1999
JP A 2001-162892 6/2001
JP A-2002-127377 5/2002
JP A 2002-273869 9/2002
JP A 2003-19790 1/2003
KR 2002-0097194 A 12/2002
WO WO 01/66357 A1 9/2001

* cited by examiner

*Primary Examiner*—Stephen Meier
*Assistant Examiner*—Brian J. Goldberg
(74) *Attorney, Agent, or Firm*—Oliff & Berridge, PLC

(57) ABSTRACT

To provide a liquid discharger and a method to discharge liquid in which lowering of the precision of the assembly and the discharge accuracy of the high-viscosity liquid caused by thermal deformation, such as thermal expansion, is suppressed when the discharge heads of the inkjet apparatus are heated to accurately discharge the high-viscosity liquid, a liquid discharger having discharge heads to pressurize functional liquid contained in cavities communicating with nozzles and discharge the functional liquid from the nozzles, a mounting plate having openings to mount the discharge heads, a tank to contain the functional liquid discharged from discharge heads, and a liquid supply channel to supply the functional liquid from the tank to the discharge heads, the discharge heads mounted to the openings of the mounting plate at a same temperature as the temperature the functional liquid is discharged from the discharge heads.

9 Claims, 7 Drawing Sheets

LIQUID DISCHARGER AND METHOD FOR DISCHARGING LIQUID DROPLETS

BACKGROUND OF THE INVENTION

1. Field of Invention

The present invention relates to a liquid discharger and a method to discharge droplets.

2. Description of Related Art

Inkjet printing (a method to discharge droplets) is known as a method to pattern electrical leads. Inkjet printing is a printing technology well-known through ink-jet printers. In inkjet printing, ink contained in a discharge head of the inkjet apparatus (liquid discharger) is discharged as droplets from discharge heads and is applied onto a surface of a substrate. By employing inkjet printing, ink droplets can be accurately discharged onto a minute area. Thus, the ink can be applied onto desired areas without employing photolithography. Inkjet printing is an extremely practical method since ink is not wasted and production costs are lowered.

An inkjet apparatus having a multi-head structure including a plurality of discharge heads serially aligned and capable of accurate inkjet drawing is already known in the related art (see Japanese Unexamined Patent Application Publication No. 2002-273869). For such a multi-head structure, accurate alignment of the discharge heads is required. A technology to assemble the discharge heads with high precision is already known (see Japanese Unexamined Patent Application Publication No. 2001-162892).

Recently, inkjet apparatus to discharge high-viscosity liquid (functional liquid), such as a lubricant or a resin are known in the related art. Such an inkjet apparatus has a device to heat the parts where the functional liquid flows, e.g. the discharge heads, to lower the viscosity of the functional liquid by heat (see Japanese Unexamined Patent Application Publication No. 2003-019790).

SUMMARY OF THE INVENTION

Although an inkjet apparatus has a precisely assembled multi-head structure as described in Japanese Unexamined Patent Application Publication No. 2001-162892, when the parts, such as the discharge heads, where high-viscosity liquid flows through, are heated, as described in Japanese Unexamined Patent Application Publication No. 2003-019790, the discharge heads and/or the portions supporting the discharge heads undergo thermal deformation, such as thermal expansion. As a result, the distance between the discharge heads changes, making it difficult to maintain the highly precise assembly. When high-viscosity liquid is discharged from discharge heads in such a condition, errors occur in the landing positions of the high-viscosity droplets. Accordingly, the high-viscosity droplets cannot be accurately discharged onto a minute area.

A liquid discharger for an inkjet apparatus having a multi-head structure to discharge high-viscosity functional liquid, such as a lubricant or a resin according to an aspect of the present invention has taken into consideration such problems. The present invention provides a liquid discharger and a method to discharge liquid in which lowering of the precision of the assembly and the discharge accuracy of the high-viscosity liquid caused by thermal deformation, such as thermal expansion, is suppressed when the discharge heads of the inkjet apparatus are heated to accurately discharge the high-viscosity liquid.

To achieve the above-mentioned, an aspect of the present invention adopts the following.

Specifically, a liquid discharger according to an aspect of the present invention includes a plurality of discharge heads to pressurize functional liquid and discharge the functional liquid contained in cavities communicating with the nozzles from nozzles, a mounting plate having openings to mount the plurality of discharge heads, a tank containing the functional liquid to be discharged from the plurality of discharge heads, and a liquid supply channel to supply the functional liquid from the tank to the plurality of discharge heads. The plurality of discharge heads are mounted to the openings at the same temperature as that when the functional liquid is discharged from the plurality of discharge heads.

Here, the term "functional liquid" refers to high-viscosity liquid, such as a lubricant, resin, or liquid crystal.

The term "a plurality of discharge heads" implies the so-called multi-head structure. In an aspect of the present invention, a plurality of discharge heads are mounted to the openings of the mounting plate at an equal pitch, forming the multi-head structure.

The term "discharge heads discharging functional liquid" refers to the plurality of discharge heads having a heating device to fluidize the high-viscosity functional liquid. By heating the functional liquid with the heating device, the viscosity of the functional liquid is lowered. Hence, the liquid is discharged from the nozzles without causing clogging of the discharge heads.

According to an aspect of the present invention, the plurality of discharge heads are mounted to the openings on the mounting plate at the same temperature as that when the functional liquid is discharged. The discharge heads are heated when they are mounted. Therefore, expansion and/or contraction of the discharge heads and/or the mounting plate caused by a temperature difference do not occur. Thus, the discharge heads and the openings are fixed in highly accurate positions relative to each other. As a result, discharge of the functional liquid while maintaining this accuracy is possible. Furthermore, since no errors occur in the landing positions of the discharged high-viscosity droplets, the high-viscosity droplets can be accurately discharged onto minute areas.

The liquid discharger described above according to an aspect of the present invention includes the mounting plate having a heating device to heat the mounting plate.

The heating device may be an electric heater formed of nichrome wires or a chiller including pipes with liquid, such as hot water flowing through. The heating device may be mounted on the interior or exterior of the mounting plate.

According to an aspect of the present invention, the heating device mounted on the mounting plate heats the mounting plate and the discharge heads. In this way, the same effects as the above-mentioned liquid discharger are achieved. Furthermore, the mounting plate and the discharge heads are maintained at the same temperature.

In addition to the above-mentioned heating device, a temperature monitoring device to monitor the temperature of the mounting plate and controlling device to control the heating device based on the results of the monitoring by the temperature monitoring device are disposed. In this way, the temperature of the mounting plate and the discharge heads can be maintained at a predetermined temperature.

The above-mentioned liquid discharger according to an aspect of the present invention may include a detecting device to detect the positions of the nozzles of the discharge heads, a measuring device to measure the distance between at least two of the nozzles, a driving device to move one of the discharge heads and the mounting plate relative to each other based on the results measured by the measuring device, and an engaging device to engage the discharge heads to the openings on the mounting plate.

Here, the detecting device is an imaging device, such as a CCD.

The measuring device is a computer to calculate the distance between at least two nozzles by performing image processing on the image data captured by the imaging device to compute the distance between the nozzles.

The driving device linearly moves one of the discharge heads by using a linear motor and/or rotationally moves one of the discharge heads by using a stepper motor or a combination of both. For example, a combination of the driving device for planar movement (in the X and Y directions) and driving device for movement in the direction perpendicular to the X-Y plane (in the Z direction) may be used.

The engaging device engages the discharge heads to the openings in, for example, a direction perpendicular to the mounting plate. Each discharge head is engaged to each opening by moving the mounting plate or the discharge head.

According to an aspect of the present invention, the positions of nozzles of the discharge heads are detected to measure the distance between the nozzles. Then, each discharge head is aligned and engaged with a predetermined opening of the mounting plate. In this way, the same effects as the liquid discharger described above are achieved while each discharge head is disposed with a highly accurate nozzle pitch.

The above-mentioned liquid discharger according to an aspect of the present invention may include a controlling device to control the detecting device, measuring device, driving device and engaging device and to maintain an equal nozzle pitch for the discharge heads.

The controlling device may be, for example, a computer.

According to an aspect of the present invention, the same effects as the liquid discharger described above are achieved while mounting the discharge heads automatically and accurately to the openings of the mounting plate.

In the above-mentioned liquid discharger according to an aspect of the present invention, the plurality of discharge heads are fixed to the openings of the mounting plate with an adhesive.

The adhesive may be highly heat-resistant and does not expand or contract due to changes in temperature.

According to an aspect of the present invention, the same effects as the liquid discharger described above are achieved while the plurality of discharge heads is fixed to the respective openings of the mounting plate. By using the adhesive, in comparison to the using fasteners, such as screws, the discharge heads and the mounting plate can be fixed together without causing deformation of the junctions between the discharge heads and the mounting plate due to torque.

In a method to discharge droplets according to an aspect of the present invention, the functional liquid is supplied to the plurality of discharge heads mounted to the openings of the mounting plate, the functional liquid inside the cavities of the discharge heads is pressurized, and the functional liquid is discharged from the nozzles communicating with the cavities. Here, the plurality of discharge heads are mounted to the openings of the mounting plate at the same temperature as that when the functional liquid is discharged.

According to an aspect of the present invention, the plurality of discharge heads are mounted to the openings of the mounting plate at the same temperature as that when the functional liquid is discharged. Specifically, the discharge heads are heated. Therefore, expansion and/or contraction of the discharge heads and/or the mounting plate caused by a temperature difference do not occur. Thus, the discharge heads and the openings are fixed in highly accurate positions relative to each other. As a result, the functional liquid can be discharged while maintaining this accuracy. Furthermore, since no errors occur in the landing positions of the discharged high-viscosity droplets, the high-viscosity droplet can be accurately discharged onto minute areas.

In the above-mentioned method to discharge droplets according to an aspect of the present invention, the plurality of discharge heads are mounted to the respective openings of the mounting plate while the mounting plate is heated.

According to an aspect of the present invention, the same effects as the method to discharge droplets described above are achieved while the mounting plate and the discharge heads are maintained at the same temperature.

In addition to the above-mentioned heating of the mounting plate, by further including monitoring the temperature of the mounting plate and controlling the temperature of the heating device based on the monitoring results by the temperature monitoring device, the mounting plate and the discharge heads can be maintained at a predetermined temperature.

A method to discharge droplets according to an aspect of the present invention includes detecting one of the nozzles of each discharge head, measuring the distance between the nozzles, moving one of the discharge heads relative to the mounting plate, and engaging one of the discharge heads to one of the openings of the mounting plate, the plurality of discharge heads disposed at an equal nozzle pitch.

According to an aspect of the present invention, the position of one of the nozzles of each discharge head is detected, the distance between the nozzles is measured, each discharge head is aligned with the respective opening, and each discharge head is engaged with the opening of the mounting plate. In this way, the same effects as the method to discharge droplets described above are achieved while the discharge heads are disposed with an accurate nozzle pitch.

A method to discharge droplets according to an aspect of the present invention includes automatically detecting the nozzles, measuring the distance between the nozzles, moving the discharge heads and the mounting plate relative to each other, and engaging the discharge heads to the openings.

According to an aspect of the present invention, the same effects as the liquid discharger described above are achieved while mounting the discharge heads automatically and accurately to the openings of the mounting plate.

In the above-mentioned method to discharge droplets according to an aspect of the present invention, the adhesive is applied to fix the discharge heads to the openings of the mounting plate.

According to an aspect of the present invention, the same effects as the method to discharge droplets described above are achieved while the discharge heads are fixed to the openings of the mounting plate. By using the adhesive, in comparison to the using fasteners, such as screws, the discharge heads and the mounting plate can be fixed together without causing deformation of the junctions between the discharge heads and the mounting plate due to torque.

DETAILED DESCRIPTION OF EXEMPLARY EMBODIMENTS

Figure 1:
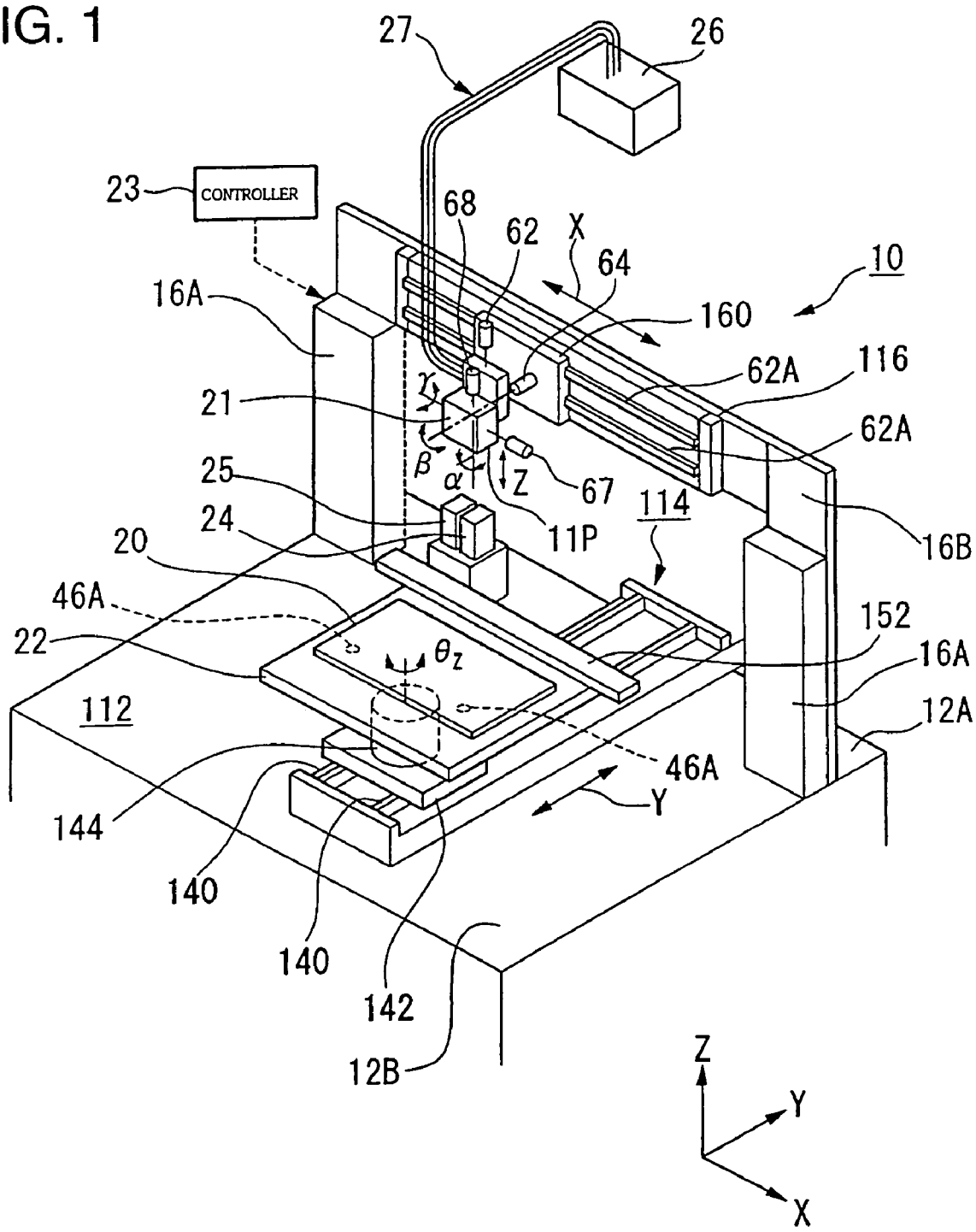
FIG. 1 is a schematic of an exemplary embodiment of a liquid discharger according to the present invention.

Exemplary embodiments of the present invention will be described below by referring to the drawings.

In FIG. 1, a liquid discharger 10 includes a base 112, a substrate stage 22 on the base 112 to support a substrate 20, a first shifter 114 disposed on the base 112 and movably supporting the substrate stage 22, a head unit 21 capable of discharging a processing liquid to the substrate 20 supported by the substrate stage 22, a second shifter 116 movably supporting the head unit 21, a tank 26 containing functional liquid, such as a liquid crystal material, a liquid supply channel 27 to supply the functional liquid to the head unit 21, a controller 23 to control the discharging of liquid by the head unit 21, and an alignment device 100. The liquid discharger 10 further has an electronic scale (not shown in the drawings) functioning as a weighing device disposed on the base 112, a capping unit 25, and a cleaning unit 24. The movement of the liquid discharger 10 including the movement of the first shifter 114 and the second shifter 116 is controlled by the controller 23.

The first shifter 114 is disposed on the base 112 along the Y direction. The second shifter 116 is attached perpendicularly to the surface of the base 112 with braces 16A and 16A on the rear portion 12A of the base 112. The second shifter 116 moves in the X direction (a second direction) from the right to the left of the base 112. The X direction is orthogonal to the Y direction. The first shifter 114 moves in the Y direction from the front portion 12B to the rear portion 12A of the base 11. Both the X and Y directions are parallel to the base 112. The Z direction is the direction perpendicular to the X and Y directions.

The first shifter 114, for example, includes a linear motor, guide rails 140 and 140, and a slider 142 mounted on the guide rails 140 and 140 so that the slider 142 can move along the guide rails 140 and 140. The slider 142 of the linear motor-driven first shifter 114 moves along the guide rails 140 and 140 in the Y direction and can be held in a predetermined position.

The slider 142 has a motor 144 that rotates on the Z axis (θZ). The motor 144 is, for example, a direct drive motor, and the rotor of the motor 144 is fixed to the substrate stage 22. In this way, by supplying electricity to the motor 114, the rotor and the substrate stage 22 can rotate on the Z axis to index the substrate stage 22. For example, the first shifter 114 can move the substrate stage 22 in the Y direction (first direction) and the θZ direction.

The substrate stage 22 supports the substrate 20 and holds it in a predetermined position. The substrate stage 22 has a suction device not shown in the drawing. By activating the suction device, the substrate 20 is sucked towards the substrate stage 22 through a hole 46A of the substrate stage 22.

The second shifter 116 has a linear motor, a column 16B fixed to the braces 16A and 16A, guide rails 62A and 62A supported by the column 16B, and a slider 160 supported by the guide rails 62A and 62A so that it can move in the X direction. The slider 160 moves along the guide rails 62A and 62A in the X direction and can be held at a predetermined position. The head unit 21 is attached to the slider 160.

The head unit 21 has motors 62, 64, 67, and 68 as oscillating positioning devices. By activating the motor 62, the head unit 21 moves vertically along the Z axis and can be held at a predetermined position. The Z axis is orthogonal to the X and Y axes. By activating the motor 64, the head unit 21 oscillates in the β direction around the Y axis and can be held at a predetermined position. By activating the motor 67, the head unit 21 oscillates in the γ direction around the X axis and can be held at a predetermined position.

By activating the motor 68, the head unit 21 oscillates in the α direction around the Z axis and can be held at a predetermined position. For example, the second shifter 116 supports the head unit 21 so that it can move in the X (first) and Z directions and the θX, θY, and θZ directions.

As described above, the head unit 21 illustrated in FIG. 1 can be held at a predetermined position by moving linearly along the Z axis on the slider 160 and oscillating in the α, β, and γ directions. The position and/or orientation of a liquid discharge surface 11P of the head unit 21 can be accurately controlled with respect to the surface of the substrate 20 on the substrate stage 22.

Figure 2A:
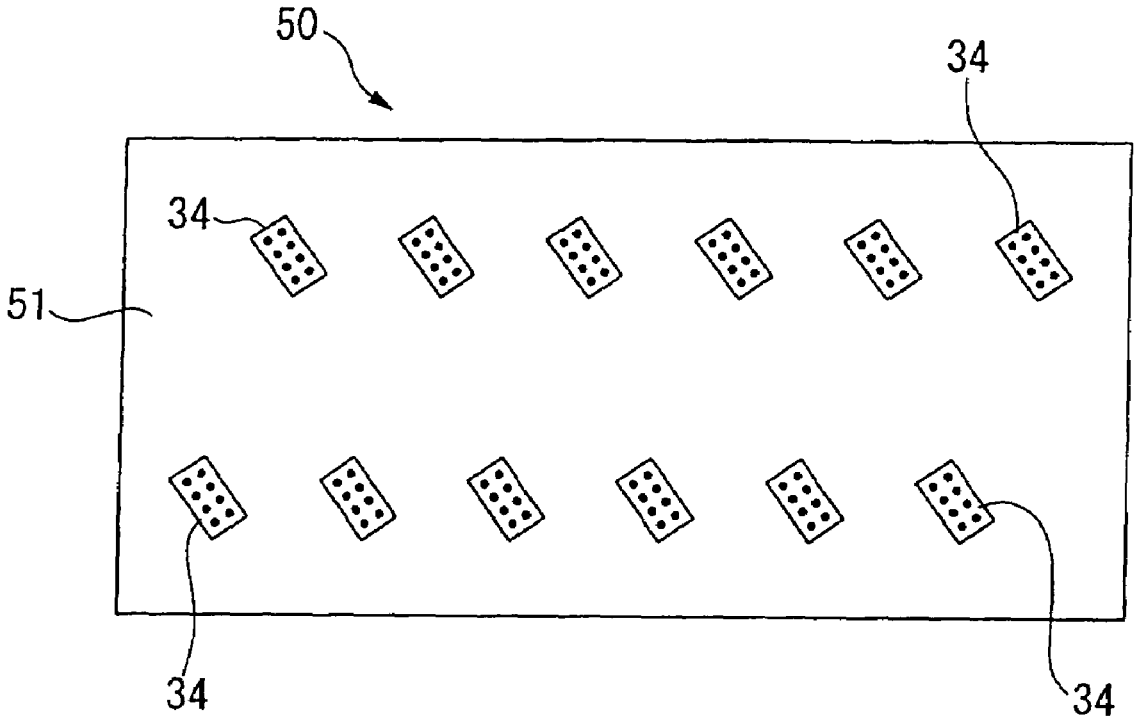
FIG. 2 is a schematic and a cross-sectional schematic of a head unit 21.
Figure 2B:
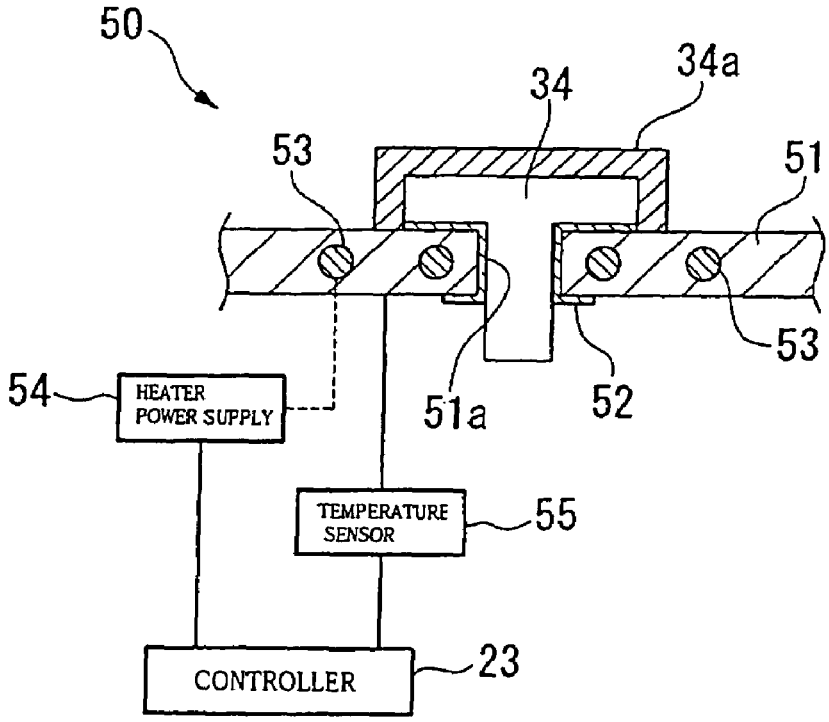

FIG. 2*a* is a schematic of the head unit 21 viewed from the substrate 20 illustrated in FIG. 1. For example, FIG. 2*a* illustrates the bottom surface of a discharge head group 50 including a plurality of discharge heads 34. FIG. 2*b* is a cross-sectional schematic of FIG. 2*a* taken along an arbitrary plane in FIG. 2*a*, illustrating the cross-sectional schematics of a mounting plate 51 and one of the discharge heads 34.

As shown in FIG. 2*a*, the head unit 21 according to this exemplary embodiment includes the rectangular mounting plate 51 and the discharge head group 50 of two rows of six discharge heads 34, i.e., a total of 12 discharge heads 34, fixed to the mounting plate 51. The discharge heads 34 are positioned at a predetermined angle so that the apparent pitch between nozzles is decreased. In this way, the distance between the discharged droplets becomes small, enhancing the discharge accuracy. Since the discharge head group 50 has a large area suitable to discharge onto a large-size substrate, in principle, the discharge head group 50 does not move in the X direction in FIG. 1, and only the substrate 20 moves in the Y direction in FIG. 1. However, if the substrate is larger than the width of the discharge head group 50, the discharge head group 50 also moves in the X direction for line feed.

As shown in FIG. 2*b*, one of the discharge heads 34 is partly engaged with a respective opening 51*a* of the mounting plate 51. The discharge heads 34 are fixed to the mounting plate 51 with an adhesive 52. A head heater 34*a* covers the discharge head 34 to heat the discharge head 34 when a high-viscosity liquid is discharged. By heating the high-viscosity liquid, the viscosity is lowered and the liquid is fluidized. The mounting plate 51 has a heater (heating device) 53. The heater 53 receives electricity from a heater power supply 54 and heats the mounting plate 51. Furthermore, the mounting plate 51 has a temperature sensor (temperature monitoring device) 55 to measure the temperature of the mounting plate 51. The temperature sensor 55 is connected to the controller (controlling device) 23. Specifically, the controller 23 controls the power supplied from the heater power supply 54 to the heater 53 in accordance with the results detected by the temperature sensor 55.

Figure 3:
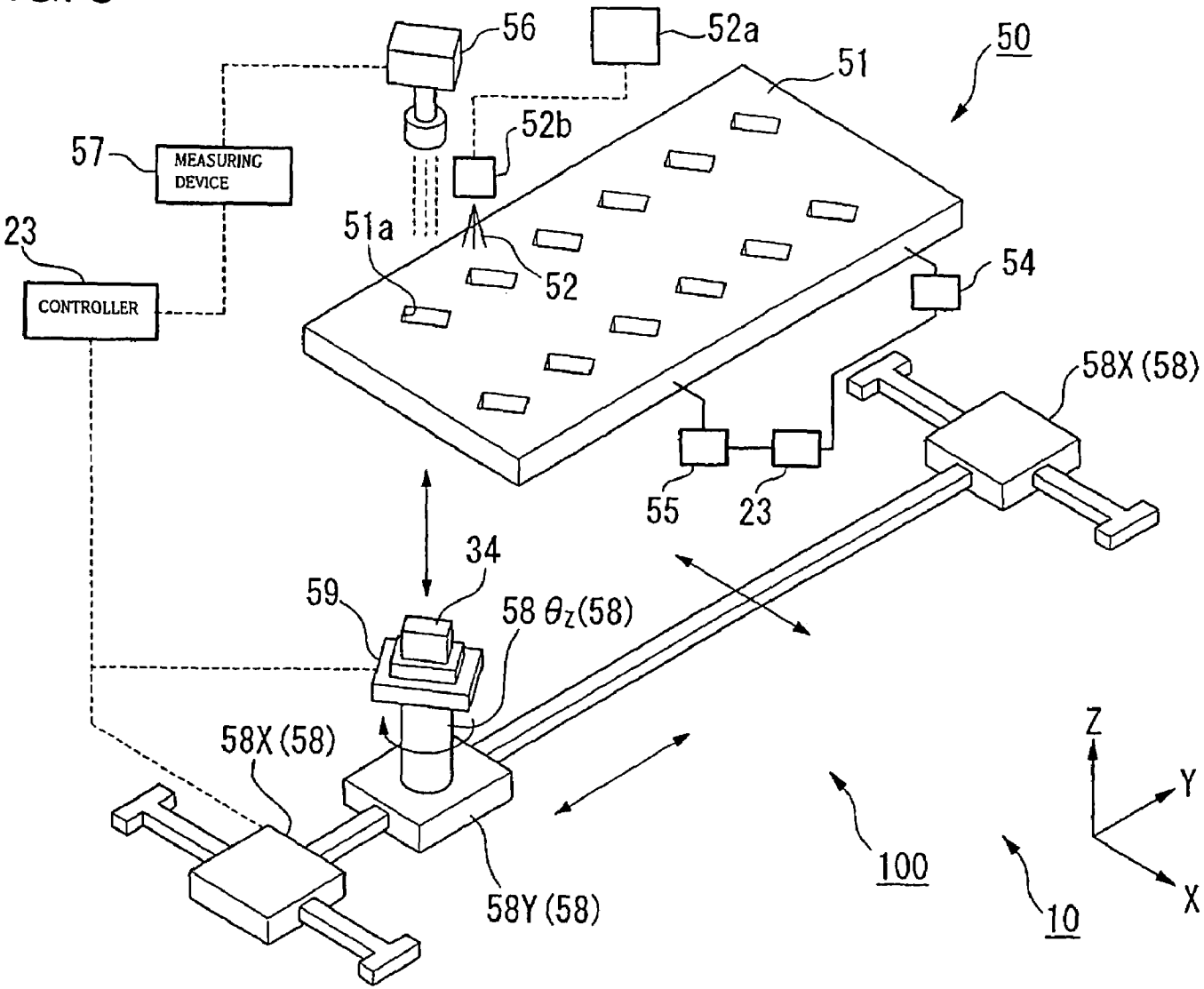
FIG. 3 is a schematic of an alignment device included in the liquid discharger.

FIG. 3 is a schematic of the alignment device 100, which is a part of the liquid discharger illustrated in FIG. 1. The alignment device 100 engages one of the discharge heads 34 to one of the openings 51*a* of the mounting plate 51 and adjusts the position of the discharge head 34.

The alignment device 100 has an imaging device (detecting device) 56, a measuring device (measuring device) 57, a driving device (driving means) 58, and an engagement mechanism (engaging device) 59.

The imaging device 56 includes a sensor, such as a DDC or a CMOS, and captures images of the opening 51*a* from above the mounting plate 51.

The measuring device 57 processes the image data captured by the imaging device 56 to compute the distance between the nozzles on the discharge head.

The driving device 58 positions the engagement mechanism 59 by relatively moving the engagement mechanism 59 and the mounting plate 51. The driving device 58 includes an X axis drive 58X to move the discharge head 34 linearly in the X direction, a Y axis drive 58Y to move the discharge head 34 linearly in the Y direction, and a θZ drive 580Z to rotate the discharge head 34 around the Z axis.

The engagement mechanism 59 is retractable in the Z direction, and the discharge head 34 on the engagement mechanism 59 is engaged with one of the openings 51*a* on the mounting plate 51.

The measuring device 57, the driving device 58, and the engagement mechanism 59 are controlled by the controller 23. The discharge head 34 is engaged with one of the opening 51*a* in a predetermined position based on the image data captured by the imaging device 56.

Furthermore, the alignment device 100 has an adhesive applying mechanism 52*a* to apply the adhesive 52 to the area near the border of the opening 51*a* and the discharge head 34. The adhesive applying mechanism 52*a* applies the adhesive 52 through an adhesive applying nozzle 52*b* to a predetermined area.

Referring back to FIG. 1, the head unit 21 (discharge head group 50) discharges liquid, such as liquid crystal (functional liquid) from nozzles by employing a so-called liquid discharge method. As the liquid discharge method, suitable methods may be employed, such as a piezoelectric method in which ink is discharged by piezoelectric elements or a method in which a liquid is discharged by generating a bubble by heating the liquid. The piezoelectric method is advantageous in that the liquid is not heated and the composition of the liquid is not affected. In this exemplary embodiment, the piezoelectric method is used.

Figure 4:
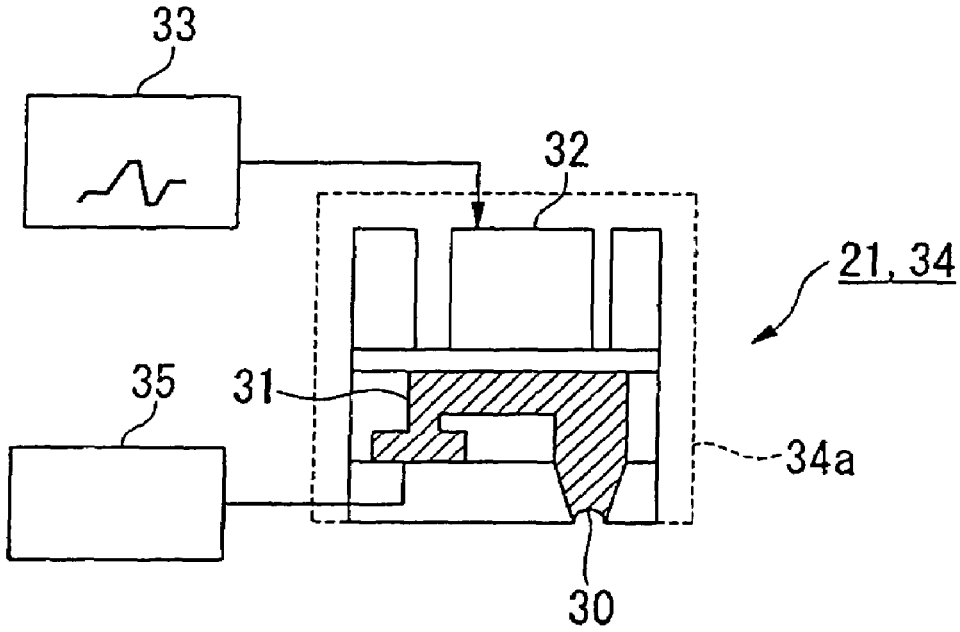
FIG. 4 is a schematic of the liquid discharge principle of a piezoelectric discharge method.

FIG. 4 illustrates the liquid discharge principle of the piezoelectric method. In FIG. 4, a liquid chamber (cavity) 31 containing liquid is disposed adjacent to a piezoelectric element 32. The liquid chamber 31 receives liquid through a liquid supplying system 35 including a tank containing the liquid. The piezoelectric element 32 is connected to a driving circuit 33. A voltage is applied to the piezoelectric element 32 via the driving circuit 33. The deformation of the piezoelectric element 32 causes the liquid chamber 31 to deform. As a result, liquid is discharged from a nozzle 30. By changing the value of the voltage applied, the deformation of the piezoelectric element 32 is controlled, and by changing the frequency of the voltage applied, the deformation rate of the piezoelectric element 32 is controlled. Specifically, in the head unit 21, the liquid discharged from the nozzle 30 is controlled by controlling the voltage applied to the piezoelectric element 32.

In this exemplary embodiment, the head heater 34*a* to lower the viscosity of the high-viscosity liquid, such as liquid crystal is disposed on the periphery of the discharge head 34.

Referring back to FIG. 1, the electronic scale (not shown in the drawing) receives, for example, 5,000 droplets from one of the nozzles of the head unit 21 to measure and control the weight of one droplet discharged from the nozzle. The electronic scale divides the total weight of the 5,000 droplets by 5,000 to accurately define the weight of a droplet. Based on the weight of a droplet, the volume of the droplet discharged from the head unit 21 can be optimally controlled.

The cleaning unit 24 cleans the nozzles of the head unit 21 regularly or on demand during the operation or stand-by of the liquid discharger. The capping unit 25 caps the liquid discharge surface 11P of the head unit 21 when not in operation or during stand-by so that the liquid discharge surface 11P does not dry out.

The second shifter 116 moves the head unit 21 in the X direction to position the head unit 21 selectively above the electronic scale, the cleaning unit 24, or the capping unit 25. For example, even if the liquid discharger is in operation, the droplets may be weighed by moving the head unit 21 to the electronic scale. By moving the head unit 21 to the cleaning unit 24, the head unit 21 can be cleaned. By moving the head unit 21 to the capping unit 25, the liquid discharge surface 11P of the head unit 21 is capped. This helps to prevent drying out.

The electronic scale, cleaning unit 24, and the capping unit 25 are positioned on the rear edge of the base 112 directly under the moving path of the head unit 21 apart from the substrate stage 22. Since the substrate 20 is supplied to or removed from the substrate stage 22 at the front edge of the base 112, the supplying or removal of the substrate 20 is not interfered by the electronic scale, the cleaning unit 24, or the capping unit 25.

As shown in FIG. 1, on the substrate stage 22, except for the part that supports the substrate 20, a preliminary discharge area 152 for the head unit 21 to perform trial discharge and preliminary discharge is disposed apart from the cleaning unit 24. The preliminary discharge area 152, as shown in FIG. 1, is disposed in the X direction along the rear edge of the substrate stage 22. The preliminary discharge area 152 is fixed to the substrate stage 22. The preliminary discharge area 152 has a U-shaped cross-sectional view with an opening on the upper part and has a replaceable absorber to absorb the discharged liquid set inside the recess of the receiver.

The tank 26 and the liquid supply channel 27 have a heating device. The heating device preheats and then retains the heat of the functional liquid, such as liquid crystal, to be discharged from the discharge head 34. In this way, the functional liquid, such as liquid crystal, flows to the discharge head 34 with its viscosity lowered to a preferable degree.

The substrate 20 may be composed of various materials, such as glass, silicon, quartz, ceramic, metal, plastic, or plastic film. The substrate composed of one of these materials may have a base layer composed of a material, such as a semiconductor film, a metal film, a dielectric film, or an organic film disposed on its surface. The plastic used to compose the substrate may be, for example, polyolefin, polyester, polyacrylate, polycarbonate, polyether sulphone, or polyetherketone.

The liquid is liquid crystal and, may be, nematic liquid crystal.

In this exemplary embodiment, a case in which the liquid discharger 10 is used to discharge liquid crystal is described. It, however, is possible to employ the present invention when high-viscosity liquid, such as a lubricant or a resin, is used as the liquid.

Next, a method to discharge droplets according to an aspect of the present invention is described.

In this exemplary embodiment, before discharging droplets to the substrate 20, engaging and fixing the discharge heads 34 to the openings 51*a* of the mounting plate 51 is performed to form a head unit having a multi-head structure.

First, the mounting plate 51 is heated to a predetermined temperature.

The predetermined temperature is preset by the controller 23, which is equal to the temperature of the discharge head 34 when it discharges droplets in a later step.

As shown in FIG. 2*b*, the temperature of the mounting plate 51 is controlled by the controller 23 so that the temperature of the mounting plate 51 complies with the preset temperature. When the temperature detected by the temperature sensor 55 is lower than the preset temperature, the heater power supply 54 is turned on. Electricity is supplied to the heater 53 and the heater generates heat, causing the temperature of the mounting plate 51 to increase. When the temperature detected by the temperature sensor 55 is higher than the preset temperature, the heater power supply 54 is turned off, causing the temperature of the mounting plate 51 to decrease. In this way, the temperature of the mounting plate 51 is controlled so as to be equal to the preset temperature.

In this exemplary embodiment, the controller 23 controls the heater power supply 54 by turning it on and off. The method to control the heater power supply 54 is not limited to this. The temperature of the mounting plate 51 may be controlled by regulating the electrical current of the heater power supply 54.

Subsequently, while the temperature of the mounting plate 51 being set, a first discharge head 34 is engaged to one of the openings 51*a*.

Specifically, the discharge head 34 is set on the engagement mechanism 59 of the alignment device 100, as shown in FIG. 3. Moreover, the imaging device 56 captures an image of the discharge head 34. Then, according to the captured image data, the driving device 58 moves the discharge head 34 disposed on the engagement mechanism 59 and the mounting plate 51 relative to each other to align the engagement mechanism 59 to the lower portion of the opening 51*a*. The engagement mechanism 59 extends in the Z direction to engage the discharge head 34 disposed on the engagement mechanism 59 with the opening 51*a*. Then, the adhesive applying mechanism 52*a* applies the adhesive 52 through the adhesive applying nozzle 52*b* to fix the first discharge head 34 inside the opening 51*a*.

Subsequently, while the temperature of the mounting plate 51 being set, a second and then a third discharge head 34 are engaged with the respective openings 51*a*. Then, the adhesive 52 is applied.

By using the alignment device 100 as described above, the second and third discharge heads 34 are each engaged with one of the openings 51*a*. Accordingly, the distance between the discharge heads of the discharge head group 50 including the first, second, and third discharge heads 34 is maintained highly accurately.

A method to fix the discharge head 34 is described in detail below by referring to FIG. 5.

Figure 5:
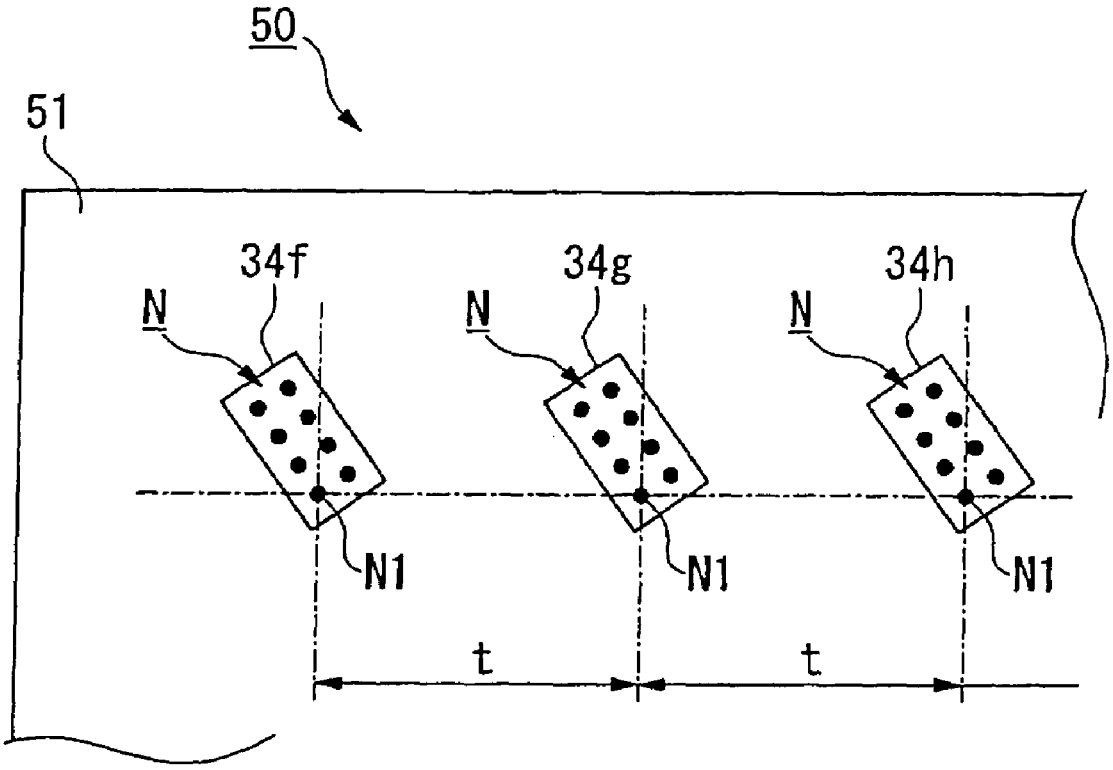
FIG. 5 is a schematic of the main parts of a discharge head group.

FIG. 5 is a plan view of a first discharge head 34*f*, a second discharge head 34*g*, and a third discharge head 34*h* representing the discharge heads 34 of the discharge head group 50.

Each discharge head 34*f*, 34*g*, and 34*h* has a nozzle group N which includes a reference nozzle N1 to position the nozzle group N on the mounting plate 51. When the second and third discharge heads 34*g* and 34*h* are fixed to the mounting plate 51, the image of each reference nozzle N1 is captured by the imaging device 56. Then, the second and third discharge heads 34*g* and 34*h* are fixed to the opening 51*a* so that the distance t, which is measured by the measuring device 57, between each reference nozzle N1 is equal.

The production of the head unit 21 is completed by disposing the discharge heads 34 (discharge head group 50) to the mounting plate 51.

In this exemplary embodiment, the first, second, and third discharge heads 34*f*, 34*g*, and 34*h* were referred to as representatives of the discharge heads 34 in the description. Other discharge heads, also, are fixed to each of the openings 51*a* with an equal distance t.

Next, the head unit 21 is set on the liquid discharger 10 to perform the discharging of the droplets.

In the discharging of the droplets, liquid crystal contained in the tank 26 is discharged from the discharge head 34 through the liquid supply channel 27. The liquid crystal is heated to a predetermined temperature by the heating device included in the tank 26 and the liquid supply channel 27. Then the liquid crystal is further heated by the head heater 34*a* for the discharge heads 34. In this way, the viscosity of the liquid crystal is lowered to a degree that facilitates discharge. While being heated, the liquid crystal is discharged onto the substrate 20 by the above-mentioned piezoelectric method according to the pattern of the electronic data set by the liquid discharger 10. Since the discharging of the droplets is performed by the head unit 21 having the plurality of discharge heads 34, the liquid crystal droplets are discharged with a predetermined pitch. The pitch of the liquid crystal droplets are determined by the distance between each of the discharge heads 34 of the discharge head group 50. In this case, the distance between each of the discharge heads 34 is equal, and, thus, the distance between the liquid crystal droplets is also equal.

As described above, on the liquid discharger 10, the discharge heads 34 are mounted to the openings 51*a* of the mounting plate 51 as they are heated to the temperature equal to the temperature the liquid crystal is heated to lower the viscosity. Therefore, when the liquid crystal is discharged, the discharge heads 34 do not undergo expansion and/or contraction caused by a temperature change. Accordingly, the discharge heads 34 and the openings 51*a* are kept in highly accurate positions relative to each other. These positions are maintained while the liquid crystal is discharged. Moreover, the liquid crystal droplets can be discharged accurately onto minute areas since there is no error in the droplet landing positions.

Moreover, the mounting plate 51 has the heater 53 to heat both the mounting plate 51 and the discharge heads 34.

Since the liquid discharger 10 has the alignment device 100, the plurality of discharge heads 34 can be disposed so that the distance between the reference nozzles N1 are equal.

Since the controller 23 automatically controls the engagement of the discharge heads 34 with the openings 51*a* and the temperature setting of the mounting plate 51, manual operation is unnecessary and the efficiency of the process is promoted.

By using the adhesive 52, the discharge heads 34 and the openings 51*a* are fixed together. In this way, no torque is applied compared to a case in which fasteners, such as screws are used. Therefore, the discharge heads 34 and the openings 51*a* can be fixed together without any distortion.

A method to make a liquid crystal display using the above-mentioned liquid discharger 10 is described below.

Figure 6:
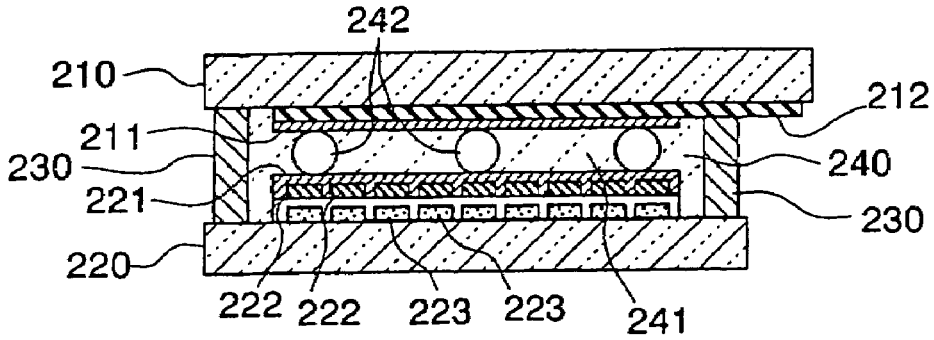
FIG. 6 is a cross-sectional schematic of a liquid crystal display produces by a liquid discharger.
Figure 7:
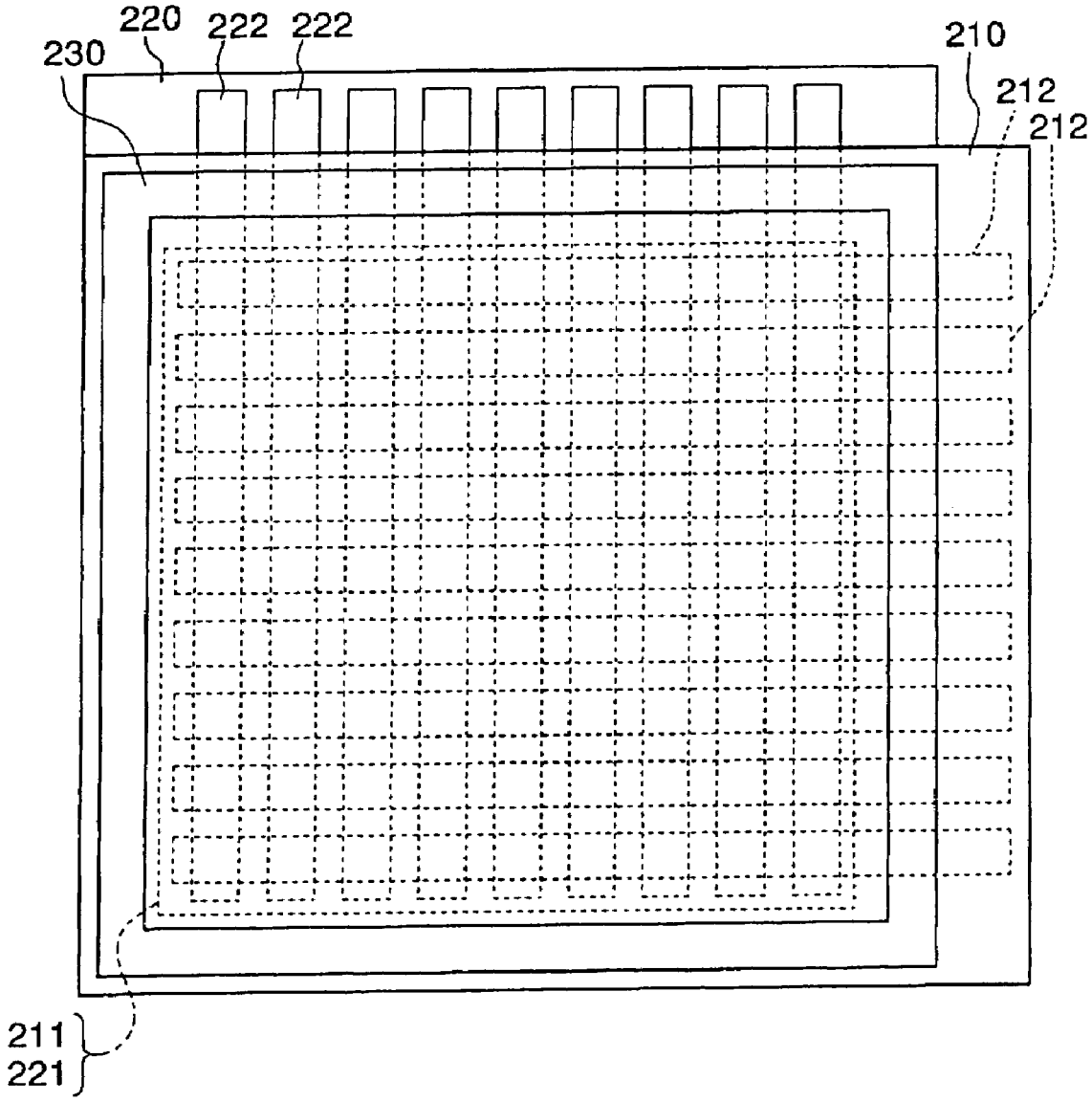
FIG. 7 is a schematic of a liquid crystal display produces by a liquid discharger.

FIG. 6 is a cross-sectional schematic of the overview of layer structure of a liquid crystal display (hereinafter referred to as "a liquid panel") produced by using the liquid discharger 10. FIG. 7 is a schematic of the overview of the liquid crystal panel viewed from the display surface. Elements, such as polarization plates and retardation plates, not referred to in the description of the present invention are omitted. The actual liquid crystal device, however, includes polarization plates and retardation plates. The size and the number of each component do not express the actual proportions.

In the description below, for convenience, the method to drive the liquid crystal is a passive matrix method. The method, however, may be other methods, such as an active matrix method.

As shown in FIGS. 6 and 7, the liquid crystal panel is basically formed of a pair of opposing glass substrates, i.e., a first substrate 210 and a second substrate 220, bonded together by a sealing material 230. Liquid crystal 241 is disposed inside a cell 240. The sealing material 230 surrounds the area that becomes a display area which is interposed between the pair of substrates 210 and 220. The liquid crystal 241 is discharged onto the substrate by the above-mentioned liquid discharger 10.

On the inner surface of the first substrate 210, first electrodes 212 composed of a transparent conductive film, such as indium tin oxide (ITO), and then an alignment film 211 composed of polyimide resin are disposed. One of the ends of the first electrodes 212 extends beyond the sealing material 230 on the substrate to form connecting terminals. On the first electrodes 212, an alignment film 211 composed of a polyimide resin is disposed. The alignment film 211 is processed to have a predetermined alignment direction.

On the inner surface of the second substrate 220, color filters 223 disposed in a sequence of red (R), green (G), and blue (B) in correspondence to the pixel areas are disposed. Then, with a cell gap between the color filters 223, second electrodes 222, composed of strips of transparent conductive material such as ITO, are disposed orthogonally to the first electrodes 212. Then, an alignment film 221 is disposed on the second electrodes 222. One of the ends of the second electrodes 222, extends beyond the sealing material 230 on the substrate to form connecting terminals. The alignment film 221 is processed to have a predetermined alignment direction.

Moreover, spacers 24 are distributed inside the cell 240 to maintain a constant cell gap.

In this liquid crystal panel, a retardation plate and a polarization plate cover the entire outer surface of the first substrate. These plates, however, are omitted in the drawing.

In general, the liquid crystal panel is produced by following the steps illustrated in FIGS. 8(*a*) to 8(*e*).

Figure 8A:
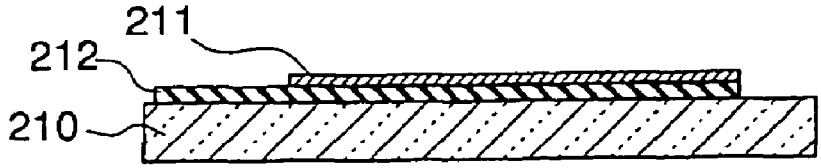
FIG. 8 is a schematic of the production process of the liquid discharger.

Forming the alignment film, as shown in FIG. 8*a*, strips of the first electrode 212, 212 are formed by photolithography on one side of the first substrate 210. Then, the alignment film 211 is disposed on the area that will be the display area in a predetermined alignment direction. One of the ends of the first electrodes 212 is extended beyond the sealing material 230 on the substrate to form connecting terminals.

Figure 8B:
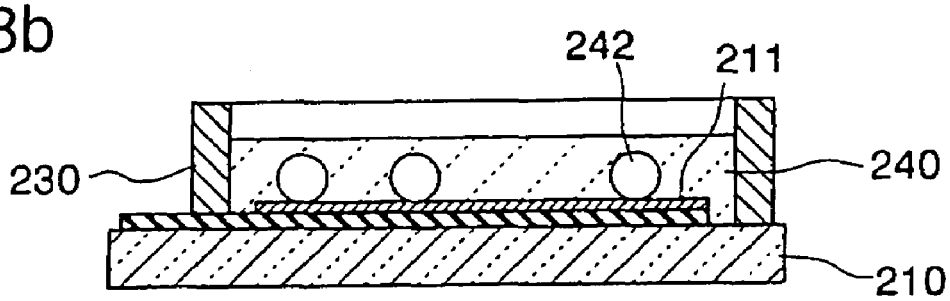

Subsequently, as shown in FIG. 8*b*, disposing the sealing material, distributing the spacers, and discharging the liquid crystal are performed.

In disposing the sealing material, the uncured sealing material 230 of photocurable resin ink is disposed around the alignment film 211.

In distributing the spacers, the spacers 242 are distributed on the alignment film 211.

In discharging the liquid crystal, the liquid crystal 241 is discharged by the above-mentioned liquid discharger 10. The viscosity of the liquid crystal 241 is lowered by heating the discharge heads 34. As a result, the liquid crystal 241 is discharged without clogging. Moreover, the discharge heads 34 are fixed to the openings 51*a* of the mounting plate 51 by the alignment device 100 at the same temperature as the temperature the liquid crystal 241 is discharged. For this reason, errors caused by heat expansion of the discharge heads 34 do not occur, and the liquid crystal 241 is discharged with high accuracy. Therefore, even when the liquid crystal 241 is discharged in the vicinity of the uncured sealing material 230, it does not contact the sealing material 230.

Figure 8C:
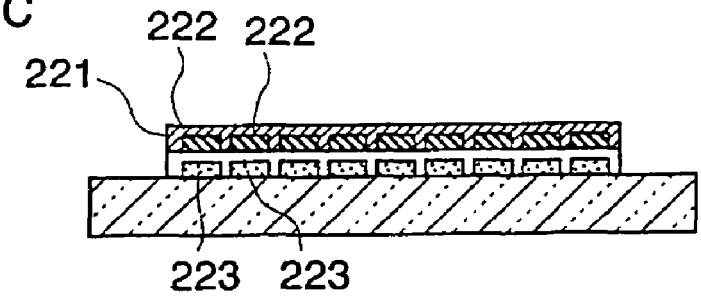

On the other hand, as shown in FIG. 8*c*, the color filters 223 (details are omitted in the drawing) are formed on one side of the second substrate 220. On the color filters 223, 223, the second electrodes 222 are disposed. Then, in the step of forming an alignment film, an alignment film 221 is disposed on the second electrodes 222 in a predetermined alignment direction. One of the ends of the second electrodes 222 extends beyond the sealing material 230 on the first substrate to form connecting terminals.

Figure 8D:
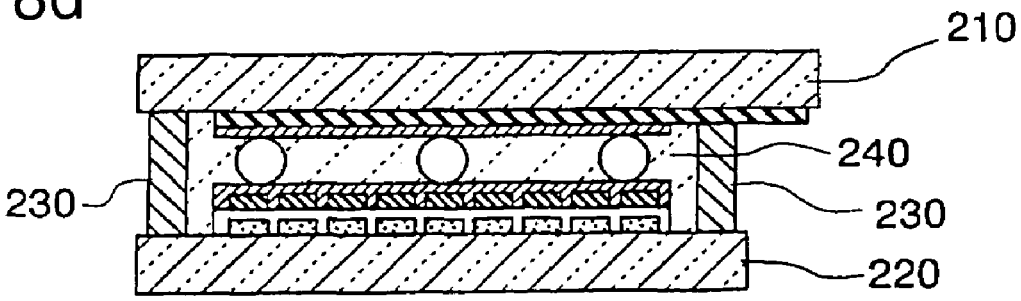

The bonding of the layers together is shown in FIG. 8*d*. The first substrate 210 is turned over and bonded with the second substrate 220 so that the alignment films 211 and 221 are disposed on the inner sides of the substrates.

However, the second substrate 220 may be turned over and bonded with the first substrate 210.

Figure 8E:
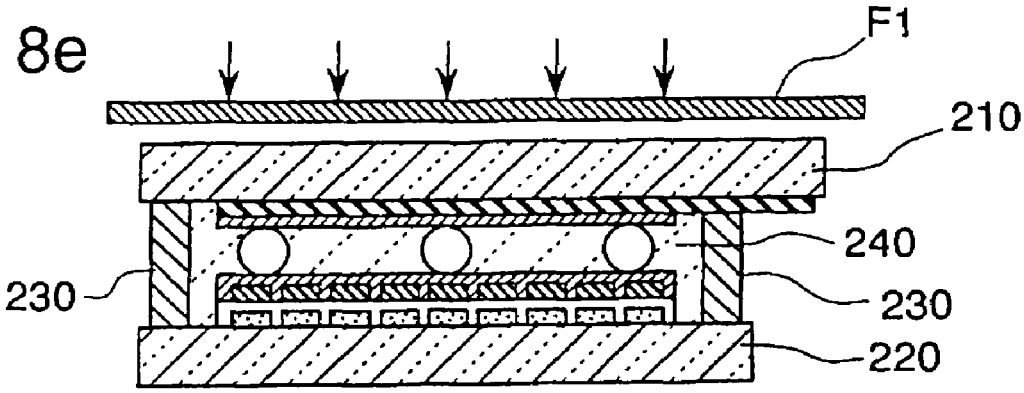

The curing of the sealing material is shown in FIG. 8*e*. The uncured sealing material 230 is cured by being irradiated with ultraviolet light emitted from an ultrahigh pressure mercury lamp through a filter F1 disposed on the outer surface of the first substrate 210, which becomes the display surface. In this case, by simultaneously exposing the sealing material 230 to light and heat, the curing process is accelerated and the sealing material 230 cures completely in a short period of time.

As described above, the liquid crystal 241 is discharged by the liquid discharger, achieving the same effects as the above-mentioned liquid discharger.

Exemplary embodiments of electronic apparatus having the liquid crystal panel are described by referring to FIG. 9.

Figure 9A:
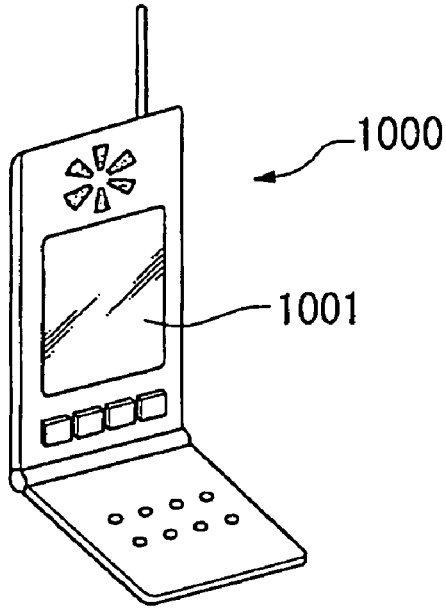
FIG. 9 illustrates electronic apparatus including a liquid crystal display.

FIG. 9*a* is a schematic of an exemplary embodiment of a cellular phone. In FIG. 9*a*, the reference numeral 1000 indicates a cellular phone body and the reference numeral 1001 indicates a liquid display.

Figure 9B:
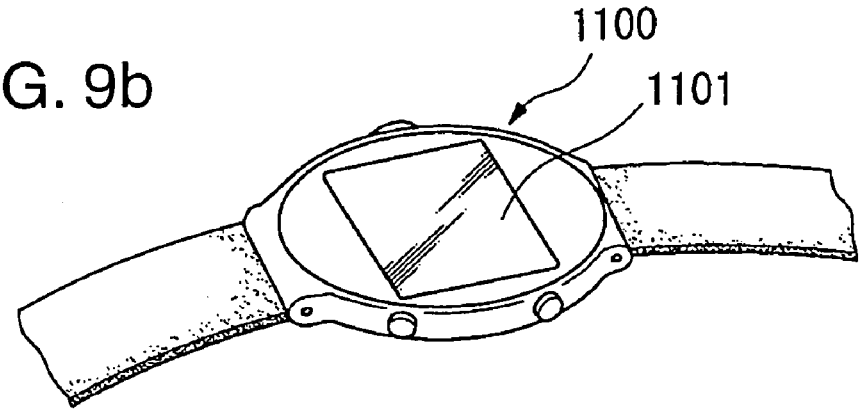

FIG. 9*b* is a perspective view of an exemplary embodiment of an electronic watch. In FIG. 9*b*, the reference numeral 1100 indicates a watch body and the reference numeral 1101 indicates a liquid display.

Figure 9C:
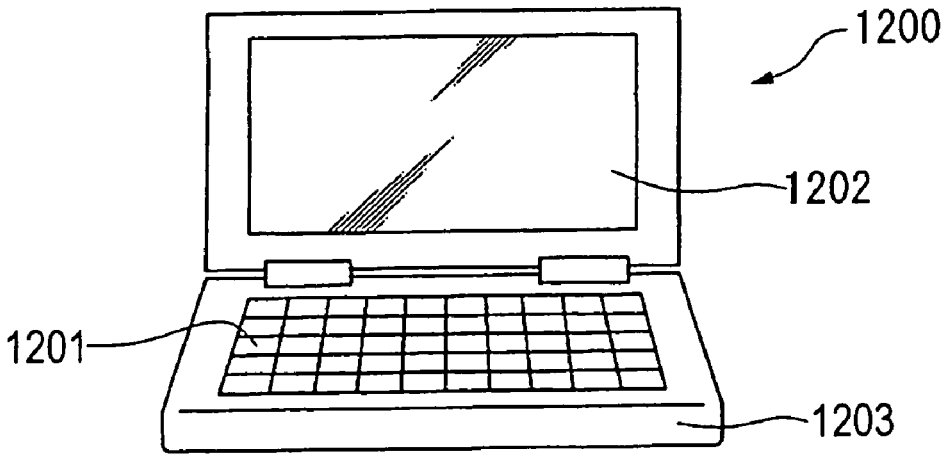

FIG. 9*c* is a perspective view of an exemplary embodiment of an electronic portable information processor, such as a word processor or a personal computer. In FIG. 9*c*, the reference numeral 1200 indicates an information processor, the reference numeral 1201 indicates an input device, such as a keyboard, the reference numeral 1202 indicates a display including a liquid crystal display, and the reference numeral 1203 indicates an information processor body.

The electronic apparatus illustrated in FIGS. 9*a* to 9*c* each have a display including a liquid crystal display according to a exemplary embodiment described above. Thus, the same effects as the above-mentioned exemplary embodiment are achieved.

These electronic apparatus are produced by incorporating the liquid crystal display according to a exemplary embodiment described above into the display of various electronic apparatus, such as a cellular phone, a portable information processor, or an electronic watch.

What is claimed is:

1. A liquid discharger comprising:

nozzles;

cavities communicating with the nozzles;

a plurality of discharge heads to pressurize functional liquid contained in the cavities communicating with the nozzles and discharging the functional liquid from the nozzles;

a mounting plate having openings to mount the plurality of discharge heads;

a tank containing the functional liquid;

a liquid supply channel to supply the functional liquid from the tank to the discharge heads, wherein the discharge heads are mounted to the openings at the same temperature as that when the functional liquid is discharged from the discharge heads;

a detecting device to detect positions of nozzles of the plurality of discharge heads;

a measuring device to measure a distance between at least two of the nozzles;

a driving device to move one of the discharge heads and the mounting plate relative to each other based on a measurement result by the measuring device; and an engaging device to engage one of the discharge heads with one of the openings.

2. The liquid discharger according to claim 1, the mounting plate having a heating device to heat the mounting plate.

3. The liquid discharger according to claim 1, further comprising:

a controlling device to control the detecting device, the measuring device, the driving device, and the engaging device to equalize the distance between the nozzles on the plurality of discharge heads.

4. The liquid discharger according to claim 1, the plurality of discharge heads fixed to the openings in the mounting plate with an adhesive.

5. A method to discharge liquid, comprising:

supplying a functional liquid to a plurality of discharge heads mounted to openings on a mounting plate;

pressurizing the functional liquid in cavities of the plurality of discharge heads; and discharging the functional liquid from nozzles communicating with the cavities of the plurality of discharge heads;

the plurality of discharge heads being mounted to the openings at a temperature that is the same temperature as when the functional liquid is discharged from the plurality of discharge heads.

6. The method to discharge liquid according to claim 5, the plurality of discharge heads mounted in the openings on the mounting plate while the mounting plate is heated.

7. The method to discharge liquid according to claim 5, the plurality of discharge heads being fixed to the openings of the mounting plate by applying an adhesive.

8. The method to discharge liquid according to claim 5, further comprising:

detecting positions of nozzles of the plurality of discharge heads;

measuring a distance between the nozzles;

moving one of the plurality of discharge heads and the mounting plate relative to each other; and engaging one of the plurality of discharge heads and one of the openings on the mounting plate;

the distance between the nozzles on each of the discharge heads being equalized.

9. The method to discharge liquid according to claim 8, the detecting of the positions of the nozzles, measuring the distance between the nozzles, moving the discharge heads and the mounting plate relative to each other, and engaging the discharge heads being performed automatically.

* * * * *